United States Patent [19]

Keyt et al.

[11] 4,139,190

[45] Feb. 13, 1979

[54] FEEDING AND SHINGLING APPARATUS

[75] Inventors: Ferris G. Keyt, Trumbull; Harold Silverman, Norwalk, both of Conn.

[73] Assignee: Pitney-Bowes, Inc., Stamford, Conn.

[21] Appl. No.: 586,646

[22] Filed: Jun. 13, 1975

[51] Int. Cl.[2] ..... B65H 29/66

[52] U.S. Cl. ..... 271/183; 271/186; 271/277

[58] Field of Search ..... 271/182–184, 271/186, 202, 275–277, 3

[56] References Cited

U.S. PATENT DOCUMENTS

| | | | |
|---|---|---|---|
| 3,141,667 | 7/1964 | Novick | 271/182 |
| 3,178,174 | 4/1965 | Schneider | 271/183 |
| 3,336,028 | 8/1967 | Schonmeier | 271/276 |
| 3,884,461 | 5/1975 | Hauser | 271/3 |

*Primary Examiner*—Robert W. Saifer

*Attorney, Agent, or Firm*—Peter Vrahotes; William D. Soltow, Jr.; Albert W. Scribner

[57] ABSTRACT

This invention relates to a sheet feeding and shingling apparatus wherein sheets are brought into an apparatus individually to be processed. The sheets are subsequently discharged from the apparatus with an overlapping relationship. This apparatus has utility in situations where sheets are individually processed, as for example in the making of copies, and must be shingled for the purpose of further handling.

3 Claims, 6 Drawing Figures

FEEDING AND SHINGLING APPARATUS

BACKGROUND OF THE INVENTION

In the paper-handling field, occasions arise where sheets are processed individually and must subsequently be gathered in order to be placed as a unit in storage or for further processing. An example of such a situation is where sheets such as pages, drawings, letters, documents and the like are processed by a facsimile machine, a copier, a photocopy machine and the like, and then must subsequently be gathered into batches. Problems arise in the gathering of such processed sheets since processing machines of the type under consideration generally require high speed and accuracy. Also, the apparatus should produce the desired results with low cost and high reliability. The apparatus conceived and described herein fully meets the requirements set forth heretofore by shingling the sheets after processing thereby placing them in a convenient condition for subsequent handling.

SUMMARY OF THE INVENTION

A sheet feeding and shingling apparatus has been conceived wherein sheets are conveyed to the apparatus and are processed individually, as for example by exposure to a document scanner of a facsimile machine. The sheets are subsequently slowed and shingled in a reliable and economical method. The sheet slowing mechanism is unique in that it applies a braking decelleration to the trailing edge of the sheets — an inherently stable situation. In conjunction with this, the apparatus can also provide means for reading information placed on the document. The conceived apparatus does not interfere with the ability to reproduce the text of the document or the transmission of information contained thereon while simultaneously providing a reliable, fast and accurate method for shingling.

Means is provided for supplying a plurality of sheets individually to a rotating drum. The sheets are held on the drum as they are conveyed across the perimeter thereof and discharged approximately 180° from the point where they were supplied to the drum. The drum rotates at a relatively high speed so that the sheets, while on the drum, are moving at a substantially higher rate of speed than that with which they are carried therefrom. Means is provided for first transferring the trailing edge of a discharged sheet taken off the drum and then braking it. This provides space for the next sheet in sequence in an overlapping relationship. The transfer of the trailing edge provides a natural blockage of the transfer port so the leading edge of the sheet is not removed from the drum first. Because the drum is moving the sheets at a higher rate of speed than the sheet discharge conveyor, a subsequent sheet will be moved relative to its immediate prior sheet and a substantial, but not complete, overlapping will take place. This sequence will continue from sheet to sheet so that a shingling procedure is established. The thusly shingled sheets may be further processed to be separated in groups or batches as desired.

Figure 1:
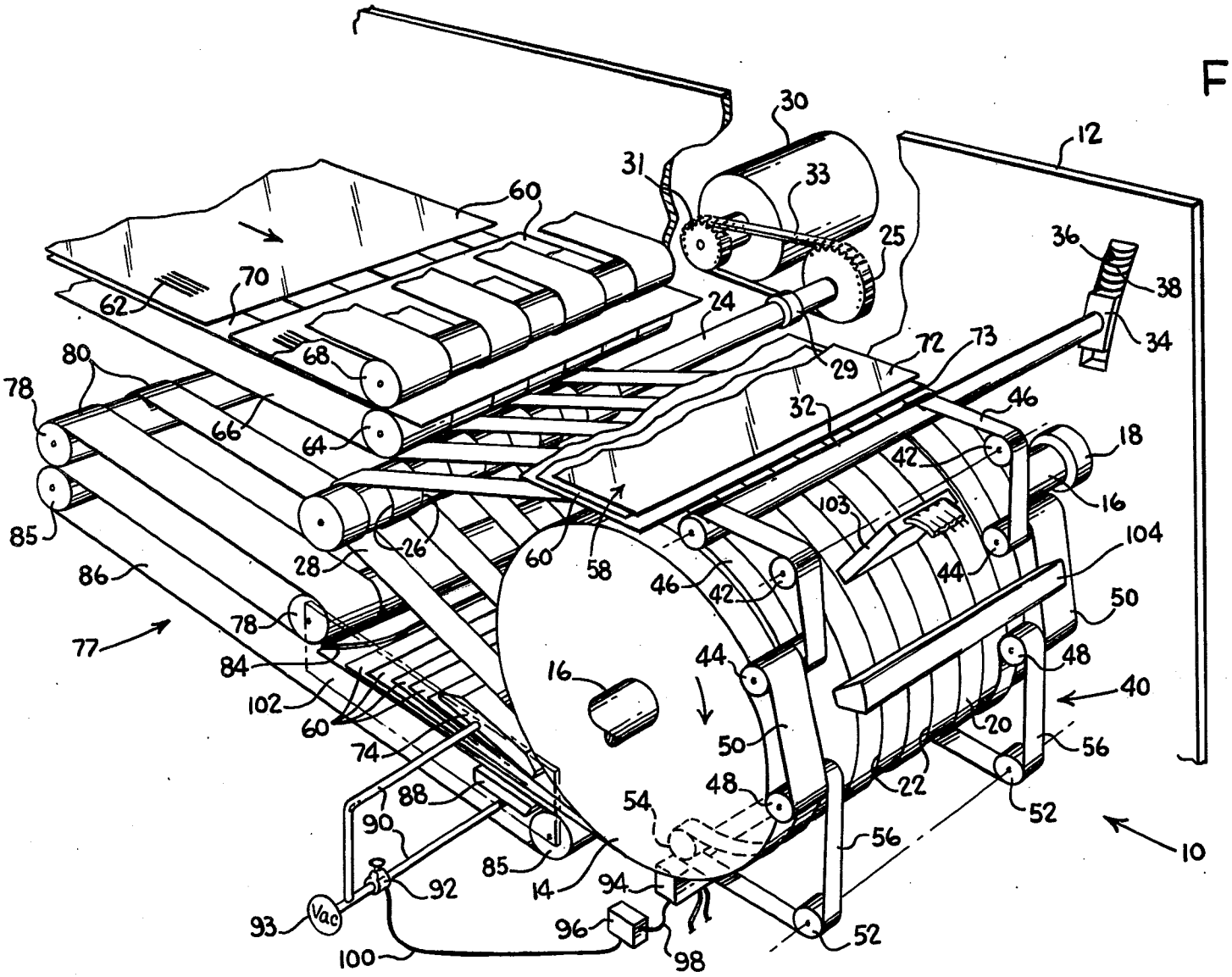
FIG. 1 is a perspective view of a sheet processing and shingled apparatus which incorporates features of this invention.

FIGS. *2a–2e* are longitudinal, cross-sectional views of the sheet feeding and shingling apparatus of FIG. 1 displaying sheets at various locations.

DESCRIPTION OF THE PREFERRED EMBODIMENTS

Referring now to the drawing, a sheet feeding and shingling apparatus is generally shown at 10 and is enclosed within a housing 12, only a portion of which is shown. A drum 14 is supported within the housing 12 by a shaft 16 which is journaled at each end into bearing members 18 (only one being shown) which are mounted on the housing. The perimeter 20 of the drum has a plurality of laterally spaced, circumferential grooves 22 located therein. Spaced relative to the drum 14 is a drive shaft 24 having a sprocket 25 mounted on one end for rotation therewith. The drive shaft 24 also has a plurality of circumferential grooves 26 therein which are laterally aligned (relative to the apparatus 10) with the circumferential grooves 22 of the drum 14. A plurality of belts 28 are received within aligned grooves 22, 26 of the drum 14 and drive shaft 24 respectively. Each end of the drive shaft 24 is journaled within a bearing member 29 (only one being shown) that is mounted on the housing 12. One end of the shaft, as shown, extends through the bearing member 29 and beyond the housing 12, which end has the sprocket 25 mounted thereon. A motor 30 having sprocket 31 is operative to selectively rotate the drive shaft 24 in cooperation with a chain 33 carried by the sprockets 25, 31.

Located at the top of the drum 14 is a pressure roller 32 whose ends are journaled into bearing members 34 (only one being shown) that are slidably received within channels 36 located within the housing 12. The channels extend radially relative to the drum 14 in a direction from the perimeter 20 to the center of the drum. Spring members 38 are received within the channels 36 and contact the upper portions of the bearing members 34 to provide a biasing force on the pressure roller 32. It will be evident from the described construction that the force imparted by the springs 38 upon the pressure roller 32 has a vector directed from the perimeter 20 toward the center of the drum 14. The pressure roller 32 should be made of a material having high resistance to abrasion and which will provide a positive pickup of sheets. An example of such a material is urethene.

The drum 14 is provided with a belt system 40 that is designed to hold sheets or documents firmly against the drum. The belt system 40 includes a plurality of pulleys upon which belts are rotatably supported. For reasons of brevity and clarity of the drawing, means for supporting the pulleys within the housing 12 will not be shown or described as the manner of doing so is well known and well within the knowledge of those skilled in the art.

Two pairs of opposed pulleys 42 and 44 are supported within the housing 12 and form a pair of generally triangular configurations in combination with the pressure roller 32. A pair of opposed belts 46 are disposed about the pulleys 42 and 44 and the pressure roller 32. The belts 46 firmly engage the drum 14 at their lower surfaces. Another pair of opposed pulleys 48 are rotatably supported within the housing 12 and in combination with the pulleys 44 support another pair of opposed belts 50. Again, the lower surface of the belts 50 are in firm engagement with the drum 14. Located at the bottom portion of the drum 14 is another combination of paired pulleys 52 and 54 which in cooperation with the pulleys 48 support still another pair of belts 56 which firmly engage the drum 14. It will be appreciated that all the belts 46, 50 and 56 are supported by their respective pulleys in such a fashion that each belt is not only in direct contact with the drum 14 but also spaced from their respective paired belts a distance such that only that portion of the sheets immediately adjacent their edges would be engaged by the belts.

Located at the upper portion of the drum 14 adjacent to the pressure roller 32 is a sheet transport mechanism 58 having sheets or documents 60 individually disposed thereupon. The sheet transport mechanism 58 is operative to transport sheets to the nip of the belts 28 and the belts 46 disposed about the pressure roller 32. Such transport mechanisms 58 are well known in the art and for that reason will not be described in great detail. By way of example however, the sheet transport mechanism may include a pair of lower rollers 64 about which a plurality of lower belts 66 are disposed and a pair of upper rollers 68 about which a plurality of upper belts 70 are disposed. A pair of opposed panels 72, 73 may be located between the belts 66, 70 and the drum 14 to receive, guide and support the sheets 60 as they are transported into the drum with their longer dimension extending axially relative to the drum. The sheet 60 may have a code 62 thereon, which code may be read by appropriate optical reading systems.

Figure 2A:
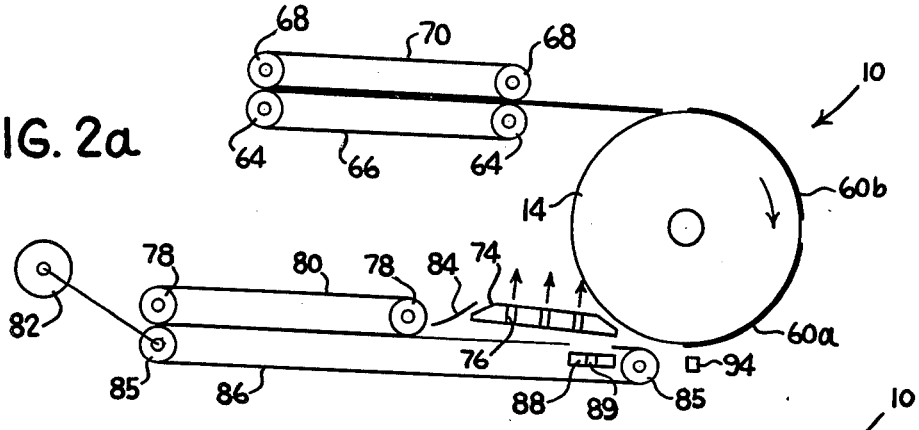

At the lower portion of the drum 14 is an upper vacuum shoe 74 having a plurality of ports 76 extending the length thereof along its lower surface. A discharge conveyor 77 is also located at the lower portion of the drum 14 and includes a pair of rollers 78 which are spaced longitudinally relative to one another and relative to the upper vacuum shoe 74. A plurality of belts 80 are disposed about the rollers 78. A deflector 84 is located intermediate the upper vacuum shoe 74 and the belts 80 for the purpose of diverting the leading edge of a sheet 60 downwardly as it is conveyed past the upper vacuum shoe. Located beneath the uppper shoe 74 and the upper belts 80 are a pair of opposed rollers 85 about which are disposed a plurality of belts 86 which are in engagement with the upper belts 80, there being means including a motor 82 (schematically shown in FIG. 2*a*) for driving one of the rollers. Located below the upper vacuum shoe 74 is a lower vacuum shoe 88 having a plurality of ports 89 extending along the length thereof. A vacuum line 90 having a valve 92 therein extends from the upper and lower vacuum shoes 74, 88, respectively, to a vacuum source 93. It will be noted that the valve 92 is located between the vacuum source and the lower vacuum shoe 88, while the upper vacuum shoe 78 is directly connected to the vacuum source.

A detector 94 is located beneath the drum 14 and is operative to detect the trailing edge of a sheet 60 as it is conveyed thereby. A timer-actuator 96 is in contact with the detector 94 through a lead 98 and also is in communication with the valve 92 of the vacuum line 90 through a lead 100.

A pair of opposed side guides 102 are provided adjacent the end belts 80, 86 to keep the sheets 60 properly located and aligned. Situated above the drum 14 is a code scanner 103 that is operative to read the code 62 and a document scanner 104 whose length is at least equal to the length of the sheets 60. Each of the scanners 103, 104 is supported within the housing 12 (such support not being shown). Both the code scanner 103 and the document scanner 104 convey signals to a central processing unit which may be connected therewith.

In operation a plurality of sheets or documents 60 may be conveyed individually from the transport mechanism 58 to the drum 14, the sheets being delivered to the nip of the pressure roller 32 and drum 12. At this point each sheet 60 is held firmly against the drum 14 at each end thereof by the belts 46 and the code 62 on the sheet 60 will be optically read by the code scanner 103 with the information derived therefrom being supplied to the central processing unit. Although the code scanner 103 is not a necessary part of the apparatus 10, it is included to show that the sheets 60 may be followed or traced if so desired. After the sheets are conveyed by belts 46 they are then engaged by the belts 50 to be further conveyed along the perimeter 20 of the drum 14. At this location each sheet 60 is scanned by the document scanner 104 which optically reads the information on the sheets and conveys such information to a central processing unit such as a facsimile machine. Machines of this type are well known in the art and will not be described herein. It will be noted, however, that the belts 50 are sufficiently separated so as not to interfere with the exposure of the sheets 60 to the document scanner 104. At the lower portion of the drum 14, the sheet 60 is then engaged by the belts 56.

Figure 2B:
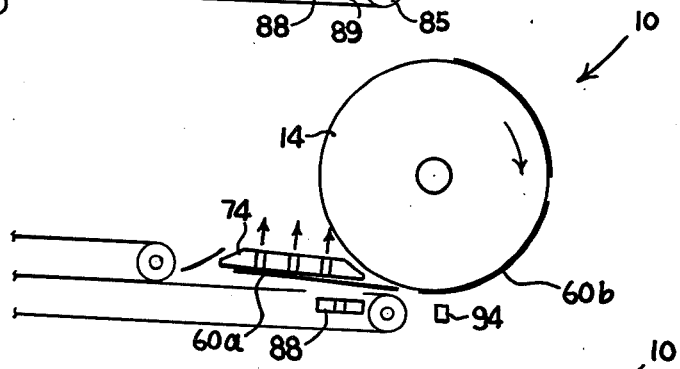
Figure 2C:
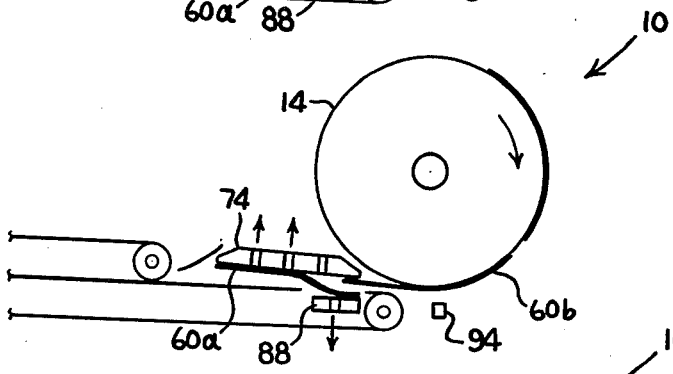
Figure 2D:
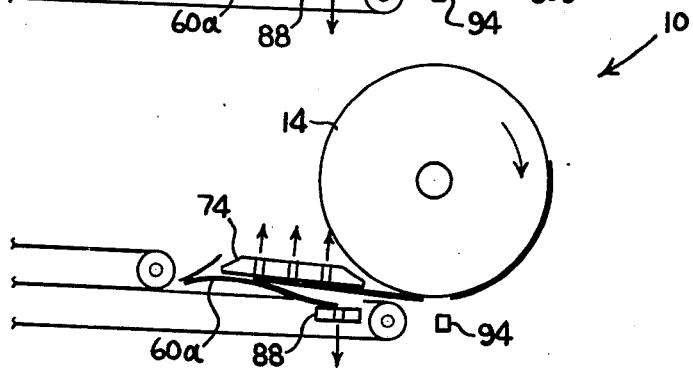
Figure 2E:
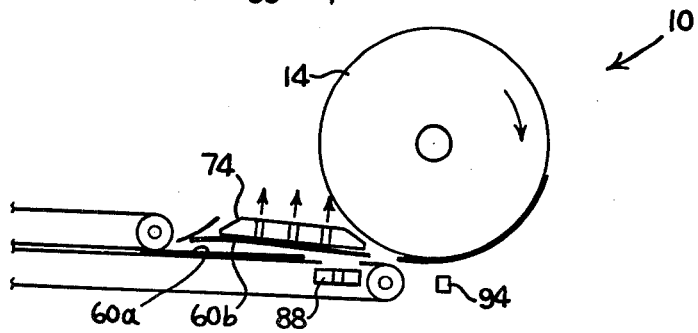

With reference to FIG. 2*a*–2*e*, the method in which the sheets 60 are discharged from the drum 14 and shingled is shown in detail. The drum 14 rotates at such a speed that the sheets 60 are discharged from the drum at a higher rate of speed than the same are conveyed away from the drum by the belts 80 and 86. As a sheet **60*a* is discharged from the drum 14 the leading edge travels intermediate the upper vacuum shoe 74 and the belt 86. The vacuum of the upper vacuum shoe 74 is constant and as the leading edge of the sheet 60*a*** approaches the vacuum shoe a normal force is applied to the sheet to direct it upwardly and hold it firmly against the upper vacuum shoe as can be seen in FIG. 2*b*. As the sheet **60*a* continues to travel across the surface of the upper vacuum shoe 74, the leading edge will engage the deflector 84 and be directed downwardly toward the nip between the belts 80 and 86** as can be seen in FIG. 2*d*. In the meantime, as the trailing edge of the sheet **60*a* departs from the drum 14, it is detected by the detector 94 which in turn actuates the timer 96. The timer 96 in turn actuates the lower vacuum shoe 88 by acting upon the valve 92 to supply a vacuum to the lower vacuum shoe. As the trailing edge of the sheet 60*a* approaches the belt 86, the trailing portion of the sheet 60*a* is pulled downwardly by the lower vacuum shoe 88** and held in that position as can be seen in FIG. 2*c*. Since the belts 80 and 86 convey the sheets 60 more slowly than the drum 14, the next in line sheet **60*b* will be conveyed past the immediately prior sheet 60*a* and be pulled upwardly by the upper vacuum shoe 74. Since the first sheet 60*a* is in engagement with the lower vacuum shoe 88 the second sheet 60*b*** will not feel the vacuum of the lower vacuum shoe. In this way, as can be seen in FIG. 2*d*, the second sheet **60*b* overlaps the first sheet 60*a* and is conveyed thereover. The timer 96 is so set that it will disable the valve 92 when the first sheet 60*a* is conveyed beyond the lower vacuum shoe 88. In this way, the second sheet 60*b* is still held against the upper vacuum shoe 74 even though the first sheet 60*a* has passed the lower vacuum shoe 88. Again the sheet 60*b* is still being conveyed by the drum and moving at a faster speed than the first sheet 60*a*. This results in the overlap between sheets 60*a*** and 60*b* increasing until the portion of sheet 60*a* which is not covered by the second sheet 60*b* becomes relatively small.

Obviously, the above sequence will continue with each succeeding sheet 60, so that ultimately a plurality of shingled sheets is achieved as shown in FIG. 1.

By way of example, a drum 14 having a circumference of 40 inches would be a convenient size for processing $8\frac{1}{4} \times 11$ sheets. If the drum 14 is rotated at a speed of $36\frac{1}{4}$ in./sec. and there is a $\frac{3}{4}''$ gap on the drum between sheets, an overlap slightly in excess of six inches will result when the discharge conveyor 77 transports sheets at a speed of 6 in./sec.

Although the invention has been shown and described with a plurality of belts holding the sheets 60 on the drum 14, it will be appreciated that other means for holding the sheets 60 to the drum are possible. For example, the drum 14 may be supplied with a plurality of ports and with vacuum means therein whereby the vacuum means will hold the sheets 60 to the drum in a manner similar to the way belts 46, 50, 56 function in the described embodiment. Such vacuum means for rotating members is well known in the art and will not be described herein.

What is claimed is:

1. A feeding and shingling apparatus, comprising: a longitudinally extending housing, a drum rotatably received within said housing, a drive shaft rotatably received within said housing, means for rotatably said drive shaft, a belt disposed about said drum and said drive shaft, a sheet transport mechanism located above the upper portion of said drum and operative to feed sheets individually to the perimeter of said drum, an axially extending pressure roller engaging the perimeter of said drum and being located adjacent said transport mechanism, a pair of first pulley assemblies located above said drum, said first pair of pulley assemblies cooperating with said pressure roller to support a first pair of belts on opposite ends of said drum and in firm engagement therewith, a second pair of pulley assemblies located on the perimeter of said drum and cooperating with said first pair of pulley assemblies to support a second pair of belts on opposite ends of said drum and in firm engagement therewith, and a third pair of pulley assemblies located on the perimeter at the bottom of said drum, said third pair of pulley assemblies being operative to cooperate with said second pair of pulley assemblies to support a third pair of belts at opposed ends of and in firm engagement with said drum, a sheet detector located immediately below said drum, a laterally extending upper vacuum shoe having a plurality of openings within the lower surfaces thereof, said upper vacuum shoe being located at the lower portion of said drum and spaced downstream from said third pair of belts, a first vacuum line communicating with said upper vacuum shoe, a laterally extending lower vacuum shoe located beneath said upper vacuum shoe and said drum, said lower vacuum shoe having a plurality of ports within the upper surface thereof, a second vacuum line communicating with said lower shoe, a valve located within said second vacuum line, a timer contacting said valve and said detector, said timer being operative to actuate said valve in response to said detector, and means located downstream from said vacuum shoes for conveying sheets away from said drum.

2. The apparatus of claim 1 including biasing means associated with said housing and providing a biasing force to said pressure roller in the direction of said drum.

3. The apparatus of claim 1 including a scanner of a document copier disposed immediately above the circumference of said drum intermediate said pressure roller and said third pair of pulley assemblies.

* * * * *